US008319379B2

(12) United States Patent
Onose et al.

(10) Patent No.: US 8,319,379 B2
(45) Date of Patent: Nov. 27, 2012

(54) PORTABLE ELECTRICAL POWER TOOL

(75) Inventors: Akira Onose, Hitachinaka (JP); Eiji Nakayama, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 256 days.

(21) Appl. No.: 12/675,116

(22) PCT Filed: Feb. 18, 2009

(86) PCT No.: PCT/JP2009/053299

§ 371 (c)(1),
(2), (4) Date: Feb. 24, 2010

(87) PCT Pub. No.: WO2009/107613

PCT Pub. Date: Sep. 3, 2009

(65) Prior Publication Data

US 2011/0241456 A1 Oct. 6, 2011

(30) Foreign Application Priority Data

Feb. 26, 2008 (JP) ..... 2008-043863

(51) Int. Cl.
*B25F 5/00* (2006.01)
*B25F 5/02* (2006.01)
*B25B 21/00* (2006.01)

(52) U.S. Cl. ..... 310/50; 173/170; 173/217; 200/332.2; 200/335

(58) Field of Classification Search ..... 310/50; 173/170, 217, 161; 200/332.2, 335; 15/167.1; 433/114, 118, 131
See application file for complete search history.

(56) References Cited

U.S. PATENT DOCUMENTS

| | | | | |
|---|---|---|---|---|
| 3,294,182 | A | 12/1966 | Filander et al. | |
| 3,973,179 | A | 8/1976 | Weber et al. | |
| 5,002,487 | A * | 3/1991 | Tichy | 433/122 |
| 6,721,986 | B2 * | 4/2004 | Zhuan | 15/22.2 |
| 2001/0031179 | A1 | 10/2001 | Potter et al. | |
| 2004/0251040 | A1 * | 12/2004 | Chu | 173/217 |

(Continued)

FOREIGN PATENT DOCUMENTS

CN 101001723 A1 7/2007

(Continued)

OTHER PUBLICATIONS

China State Intellectual Property Office (SIPO) office action for SIPO patent application CN2011112900817500 (Dec. 2, 2011).

*Primary Examiner* — Burton Mullins
(74) *Attorney, Agent, or Firm* — Kilpatrick Townsend & Stockton LLP

(57) ABSTRACT

A portable electric power tool including a housing having one end to which an L-shaped battery pack is installable. A motor is accommodated in the housing. A switch assembly includes a switch body installed in the housing. The switch body is overlapped with the L-shaped battery pack in a longitudinal direction of the power tool. The switch assembly further includes a trigger including a pivot portion, a manipulation portion extending frontward from the pivot portion and pivotally movable, and a lever portion extending rearward from the pivot portion to actuate the switch body. The manipulation portion is disposed to overlap with a center of gravity of an entire power tool in the longitudinal direction, and the pivot portion is positioned between the manipulation portion and the switch body.

8 Claims, 4 Drawing Sheets

U.S. PATENT DOCUMENTS

2005/0196273 A1 * 9/2005 Nishikawa et al. ..... 415/206
2007/0120527 A1 5/2007 Roehm et al.

FOREIGN PATENT DOCUMENTS

DE 10 2004 038 788 A1 2/2006
JP 6-285771 A 10/1994
JP 9-11141 A 1/1997
JP 2006-51571 * 2/2006
JP 2008-229740 * 10/2008
WO WO 03/059185 A2 7/2003

* cited by examiner

PORTABLE ELECTRICAL POWER TOOL

CROSS-REFERENCE TO RELATED APPLICATIONS

This application is a National Stage of International Application No. PCT/JP2009/053299 filed Feb. 18, 2009, and which claims the benefit of Japanese Patent Application 2008-043863 the disclosures of which are incorporated herein by reference.

TECHNICAL FIELD

The present invention relates to a portable electrical power tool, and more particularly, to a layout of a switch assembly, a motor, and an L-shaped battery pack assembled to one end of a housing in the power tool.

BACKGROUND ART

A portable electrical power tool has a housing in which a motor serving as a drive source is accommodated, and an L-shaped battery pack serving as a power source for driving the motor is assembled to one end of the housing. Energization and de-energization of the motor and acceleration and deceleration of the motor are performed upon operation of a switch assembly.

Japanese Patent Application Kokai No. H09-011141 discloses an angled impact driver which is one of the examples of the portable electrical power tool. The angled impact driver generates impulse rotation force upon rotation of the motor so as to impactingly rotate an end bit about its axis for facilitating a screw fastening operation. The angled impact driver provides lesser reaction force with increased fastening performance, and is particularly available for screw fastening work at a narrow working site.

Relevant conventional angled impact driver 101, 201 are shown in FIGS. 4 and 5 in which a motor 103, 203 is accommodated in a housing 105, 205 at a longitudinally center portion thereof. The housing 105, 205 also accommodates therein, at a front side of the motor 103, 203 (right side in FIGS. 4 and 5), a planetary gear deceleration mechanism 106, 206, an impulse rotation mechanism, and a bevel gears 107, 108 and 207, 208. The impulse rotation mechanism includes a spindle 110, 210, a hammer 111, 211, an anvil 104, 204, a cam mechanism, a ball 112, 212, and a spring 113, 213. An L-shaped battery pack 102, 202 is detachably attached to an end portion of the housing 105, 205. A switch assembly 119, 219 provides speed changing function and includes a switch body 120, 220 and a trigger 121, 221.

In the angled impact driver 101 shown in FIG. 4, the switch body 120 and a trigger 121 are disposed between the motor 103 and the L-shaped battery pack 102. Upon pulling the trigger 121, electrical power is supplied from the L-shaped battery 102 to the motor 103 to energize the motor 103. Further, rotation speed of the motor 103 can be changed in accordance with an amount of pulling of the trigger 121.

In the angled impact driver 201 shown in FIG. 5, the switch body 220 and the trigger 221 are disposed also between the motor 203 and the L-shaped battery pack 202. The trigger 221 is of a paddle type whose fulcrum end 222 is positioned below the switch body 220. The trigger 221 has a manipulation portion 221*a* elongating frontward from the fulcrum end 222 so that the manipulation portion 221*a* can be positioned at a center of gravity of an entire impact driver.

With this structure, an entire length of the driver 101, 201 is disadvantageously long, since the switch body 120, 220 is disposed between the motor 103, 203 and the L-shaped battery pack 102, 202. Further, in the driver 101 shown in FIG. 4, poor operability may result, since the position of the trigger 121 is not coincident with the center of gravity of the entire impact driver. In the driver 201 shown in FIG. 5, the manipulation portion 221*a* is frontwardly away from the fulcrum end 222. Therefore, the manipulation portion 221*a* is spaced away from a tool gripping portion, thereby lowering operability.

DISCLOSURE OF INVENTION

It is therefore an object of the present invention to provide a compact power tool with improved operability.

This and other objects of the present invention will be attained by providing a portable electric power tool including a housing, a motor, a trigger, and a switch body. The housing has a hand-gripped portion extending in a longitudinal direction. The hand-gripped portion has one end portion in which a battery is installable. The motor is accommodated in the housing. The trigger is provided at the hand-gripped portion and is exposed to an atmosphere for access and operation. The switch body is positioned in the housing and configured to perform switching of an electrical power supply to the motor. The switch body is positioned to be overlapped with the battery in the longitudinal direction, and the trigger extends to the switch body.

With this arrangement, an entire longitudinal length of the power tool can be reduced by mutually overlapping length between the switch body and the battery.

Preferably, the trigger includes a manipulation portion, a pivot portion, and a lever portion. The manipulation portion is externally accessible and operable. The pivot portion is supported to the hand gripped portion and pivotally movably supports the manipulation portion. The lever portion extends to the switch body from the manipulation portion via the pivot portion.

Preferably, the hand-gripped portion has another end portion in which the motor is accommodated.

Preferably, the switch body includes an ON/OFF switch. The ON/OFF switch and a part of the lever portion are positioned on a plane perpendicular to the longitudinal direction.

Preferably, the ON/OFF switch is rendered ON by the lever portion in response to the operation of the manipulation portion.

Preferably, the ON/OFF switch provides a ON direction perpendicular to a moving direction of the lever portion.

Preferably, the switch body includes a speed change switch for changing a rotation speed of the motor. The speed change switch and a part of the lever portion being positioned on a plane perpendicular to the longitudinal direction.

Preferably, the speed change switch is operated by the lever portion in response to the operation of the manipulation portion.

Preferably, the speed change switch provides a speed changing direction parallel to a moving direction of the lever portion.

Preferably, the manipulation portion extends frontward from the pivot portion and is pivotally movable toward and away from the housing. The lever portion extends rearward from the pivot portion and is movable in accordance with the movement of the manipulation portion to actuate the switch body. The manipulation portion is disposed to overlap with a center of gravity of an entire power tool in the longitudinal direction, and the pivot portion is positioned between the manipulation portion and the switch body.

With this arrangement, a distance between the hand-gripped portion and the manipulation portion can be reduced.

Therefore, a user can easily operate the manipulation portion with his finger of his hand while gripping the hand-gripped portion by his identical hand.

Preferably, the motor is disposed at a position coincident with the center of gravity.

Preferably, the motor has a motor shaft, and the power tool further includes an impact rotation transmission mechanism including a planetary gear deceleration mechanism, a spindle, a hammer, an anvil, and an output shaft. The impact rotation transmission mechanism is disposed in the housing at a position opposite to the switch body with respect to the motor. The planetary gear deceleration mechanism is driven by the motor shaft. The spindle is deceleratingly rotationally driven by the planetary gear deceleration mechanism. The hammer is rotated by the spindle. The anvil is impactingly rotated by the hammer. The output shaft is driven by the anvil and extends in a direction perpendicular to the spindle. Thus, an angled impact driver is provided.

DESCRIPTION OF REFERENCE NUMERALS

Figure 1:
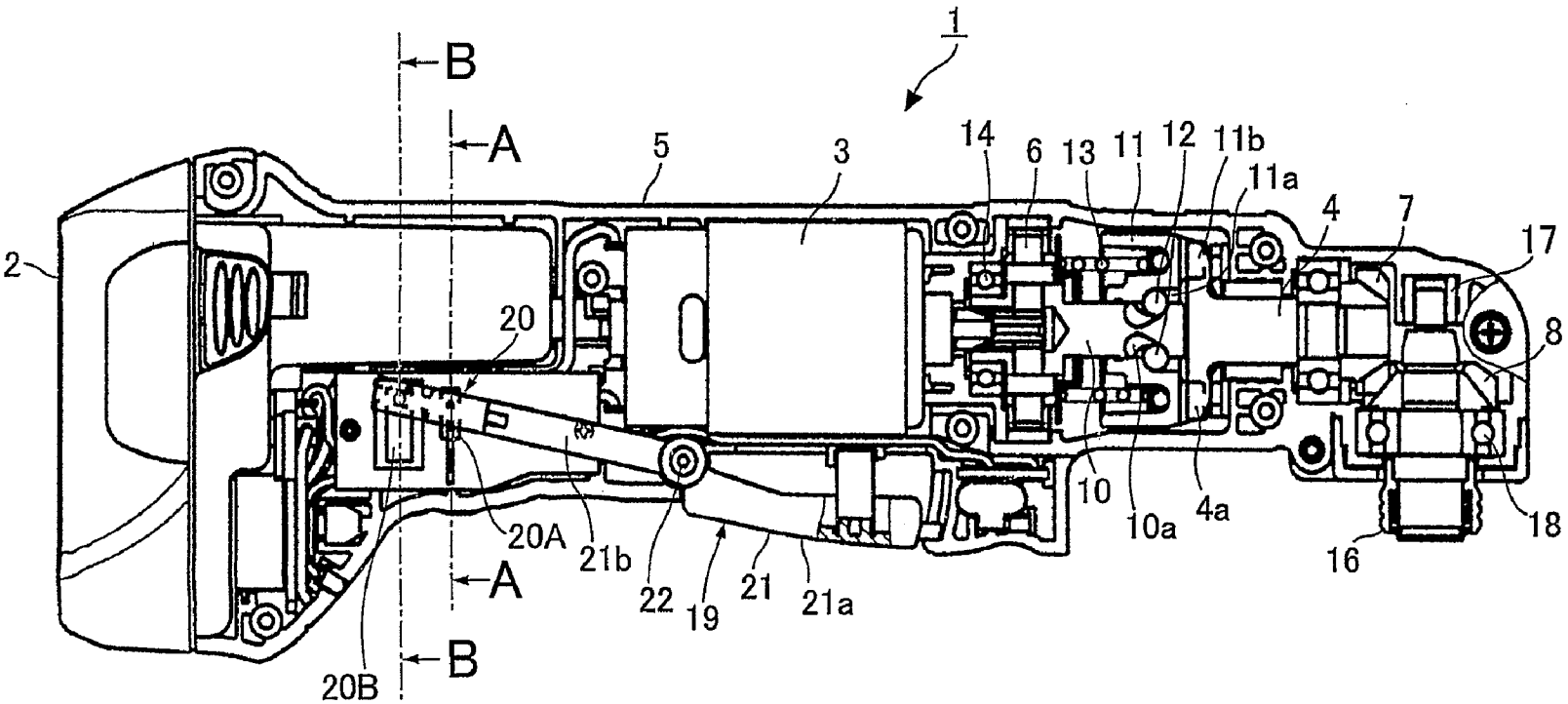
FIG. 1 is a cross-sectional side view of an angled impact driver according to one embodiment of the present invention.

1: angled impact driver as a portable power tool
2: L-shaped battery pack
3: motor
4: anvil
5: housing
6: planetary gear deceleration mechanism
7,8: bevel gear
10: spindle
11: hammer
19: switch
20: switch body
20A: ON/OFF switch
20B: speed change switch
21: trigger
21*a*: manipulation portion
21*b*: lever portion
22: pivot portion

BEST MODE FOR CARRYING OUT THE INVENTION

A power tool according to one embodiment of the present invention will be described with reference to FIGS. 1 through 3. The depicted embodiment pertains to an angled impact driver.

The angled impact driver 1 is a cordless type portable or hand-carried power tool having a motor 3 as a drive source, a battery such as an L-shaped battery pack 2 as a power source, and an impulse rotation mechanism driven by the motor 3. In the impulse rotation mechanism, an anvil 4 is subjected to impulse rotation force, which will be transmitted to an end bit (not shown), whereby the end bit can be impactingly rotated about its axis to perform screw fastening operation.

More specifically, the angled impact driver 1 has an elongated cylindrical housing 5 as shown in FIG. 1. The housing 5 is constituted by complementary two housing halves 5A, 5B coupled to each other, and is made from a resin. The housing 5 has a front end portion having an L-shaped or angled shaped configuration. The housing has a lontitudinally extending portion serving as a hand-gripped portion. The housing 5 has a rear longitudinal end portion (one end portion of the hand-gripped portion) assembled with the slidable L-shaped battery pack 2. The motor 3 having a motor shaft is accommodated in another end portion of the hand gripped portion of the housing 5, and further, a planetary gear deceleration mechanism 6, the impulse rotation mechanism, and bevel gears 7 and 8 are accommodated in the housing 5 at a front side (right side in FIG. 1) of the motor 3.

The impulse rotation mechanism includes a spindle 10, a hammer 11, an anvil 4, a cam mechanism, and a spring 13. The rotation of the motor shaft is deceleratingly transmitted to the spindle 10 by the planetary gear deceleration mechanism, so that the spindle 10 can be rotated at a predetermined speed. The hammer 11 is rotatably mounted over an outer peripheral surface of the spindle 10 and is connected to the spindle 10 by the cam mechanism. The cam mechanism is provided by a V-shaped cam groove 10*a* formed at the outer peripheral surface of the spindle 10, a V-shaped cam groove 11*a* formed at an inner peripheral surface of the hammer 11, and a ball 12 engaged with these cam grooves 10*a* and 11*a*.

The hammer 11 is biased frontward (rightward in FIG. 1) by the spring 13. The hammer 11 has an end face in direct confronting with the anvil 4, and a pair of engagement protrusions 11A protrude from the end face toward the anvil 4 at diametrically opposite sides thereof. The anvil 4 is disposed at immediate front side of the hammer 11, and has an end face in direct confrontation with the end face of the hammer 11, and the end face is provided with a pair of engagement protrusions 4*a* protruding toward the hammer 11 and positioned at diametrically opposite sides. The engagement protrusions 11*b* and 4*a* are selectively engaged with each other in accordance with the rotation of the spindle 10. The anvil 4 is rotatably supported to the front portion of the housing 5 through a bearing 14, and the anvil 4 has a front end portion coupled with a bevel gear 7. More specifically, the bearing 14 rotatably supports the spindle 10, so that the spindle 10 can support the anvil 4.

At the front end portion of the housing 5, an output shaft 16 is rotatably supported through two bearings 17 and 18. In FIG. 1, the front end portion of the housing 5 is bent downward. The output shaft 16 extends in a direction perpendicular to an axial direction of the anvil 4. The output shaft 16 has an intermediate portion at a position between the bearings 17 and 18, the intermediate portion being coupled with a bevel gear 8 meshingly engaged with the bevel gear 7. An end bit (not shown) is detachably attached to the output shaft 16.

A longitudinally intermediate portion of the housing 5 has a lower portion to which a switch assembly 19 is pivotally movably attached. The switch assembly 19 is adapted for turning ON/OFF the power supply from the L-shaped battery pack 2 to the motor 3 and for changing rotation speed of the motor 3. The switch assembly 19 includes a trigger 21 having a pivot portion 22, and a switch body 20.

More specifically, the trigger 21 is pivotally supported to the end portion of the hand gripped portion of the housing 5 by the pivot portion 22, and includes a manipulation portion 21*a* located at a front side of the pivot portion 22 and a lever portion 21*b* located at a rear side thereof. The manipulation portion 21*a* is exposed to an atmosphere for user's access and manipulation. The manipulation portion 21*a* is positioned below the motor 3 whose position is coincident with a center of gravity of the entire impact driver. The switch body 20 is positioned to overlap with the battery pack 2 in the longitudinal direction. That is, the switch body 20 is positioned below an internally inserted portion of the battery pack 2. The lever portion 21*b* extends to the switch body 20 for driving the switch body 20. In other words, the pivot portion 22 is positioned between the manipulation portion 21*a* and the switch body 20.

Figure 2:
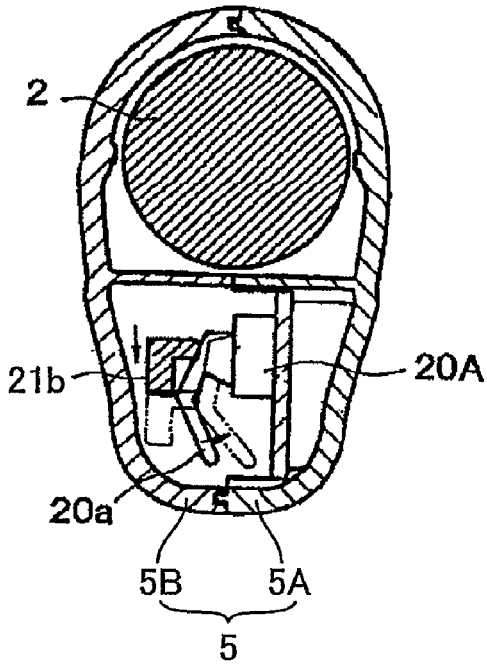
FIG. 2 is a cross-sectional view taken along the line A-A in FIG. 1.
Figure 3:
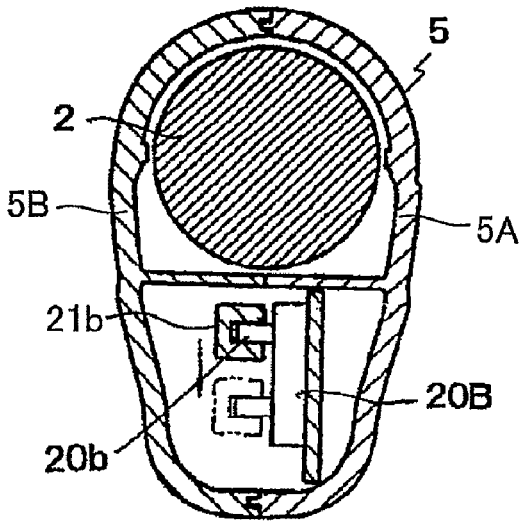
FIG. 3 is a cross-sectional view taken along the line B-B in FIG. 1.
Figure 4:
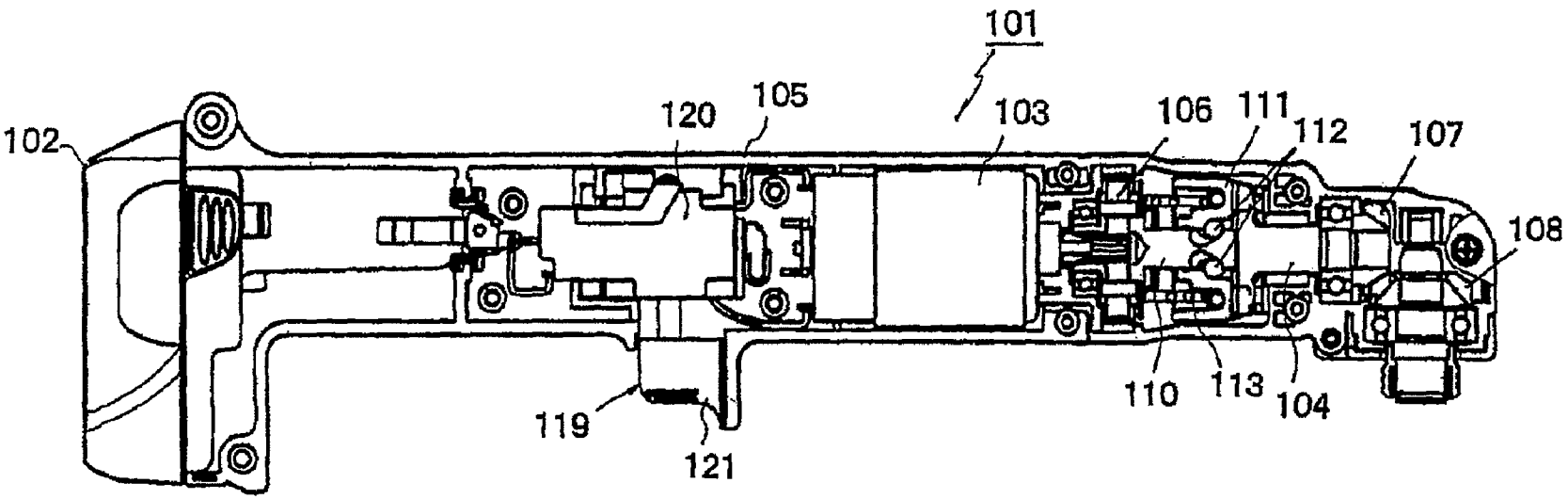
FIG. 4 is a cross-sectional side view of a conventional angled impact driver.
Figure 5:
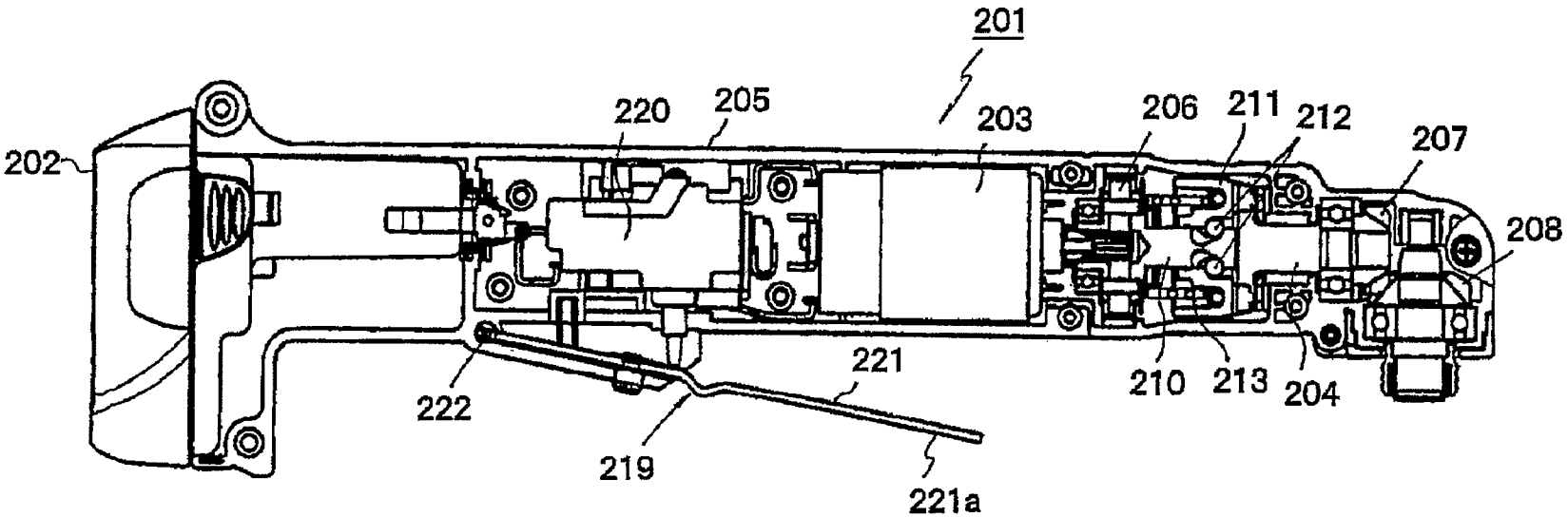
FIG. 5 is a cross-sectional side view of another conventional angled impact driver.

The switch body 20 includes an ON/OFF switch 20A shown in FIG. 2 and a speed change switch 20B shown in FIG. 3. The ON/OFF switch 20A includes a V-shaped actuation piece 20*a*, and the speed change switch 20B includes an actuation piece 20*b*. The ON/OFF switch 20A and a part of the lever portion 21*b* are positioned on an imaginary plane perpendicular to the longitudinal direction of the hand-gripped portion of the housing 5 as shown in FIG. 2. The ON/OFF switch 20A provides a ON direction perpendicular to a moving direction of the lever portion 21*b*. Further, the speed change switch 20B provides a speed change direction parallel to the moving direction of the lever portion 21*b*. The speed change switch 20B and another part of the lever portion 21*b* are positioned on another imaginary plane perpendicular to the longitudinal direction of the hand-gripped portion of the housing 5 as shown in FIG. 3.

If the manipulation portion 21*a* is not pulled, the lever portion 21*b* and the actuation pieces 20*a*, 20*b* are positioned at solid line positions where the ON/OFF switch 20A is rendered OFF. Therefore, no power supply is performed from the battery pack 2 to the motor 3.

If the manipulation portion 21*a* is pulled, the lever portion 21*b* is pivotally moved about the pivot portion 22 to its dotted line positions to urge the actuation pieces 20*a* and 20*b* to the dotted line positions in FIGS. 2 and 3. As a result, the ON/OFF switch 20A is rendered ON to start power supply from the battery pack 2 to the motor 3 for energizing the same. Further, the rotation speed of the motor 3 will be increased in accordance with the movement of the actuation piece 20*b* in a direction indicated by an arrow in FIG. 3. That is, the motor speed is proportional to the pulling amount of the manipulation portion 21*a* of the trigger 21.

During de-energization state of the motor 3, the hammer 11 is spaced away from the end face of the anvil 4 by the engagement between the ball 12 and the cam grooves 10*a*, 11*a*, so that a minute clearance is provided between the hammer 11 and the anvil 4.

Upon energization of the motor 3, the rotation of the motor shaft is deceleratingly transmitted to the spindle 10 through the planetary gear deceleration mechanism 6, so that the spindle 10 can be rotated at a predetermined speed. The rotation of the spindle 10 is transmitted to the hammer 11 through the cam mechanism. Immediately before the hammer 11 being rotated by 180 degrees, the protrusions 11*b* of the hammer 11 are brought into engagement with the protrusions 4*a* of the anvil 4 to rotate the anvil 4. In this instance, a reaction force is generated to generate relative rotation between the hammer 11 and the spindle 11, so that the hammer 11 will be moved toward the motor 3 along the spindle cam groove 10*a* while compressing the spring 13.

Because of the movement of the hammer 11 against the biasing force of the spring 13, the protrusions 11*b* of the hammer 11 will move past the protrusions 4*a* of the anvil 4 in the rotating direction to release engagement between the protrusions lib and 4*a*. Consequently, the hammer 11 will be rapidly and acceleratedly rotated about its axis and moved in its axial direction because of the rotation force of the spindle 11, resilient energy accumulated in the spring 13 and actuation of the cam mechanism. Accordingly, the protrusions 11*a* of the hammer 11 are again brought into engagement with the protrusions 4*a* of the anvil 4 to start rotation of the anvil 4 along with the hammer 11. In other words, impulse rotation force is applied to the anvil 4 from the hammer 11, and this impulse rotation force will be transmitted to the output shaft 16 through the bevel gears 7 and 8. Thus, impulse rotation force can be applied to the end tool (not shown) assembled to the output shaft 16. Here, the output shaft 16 and the end tool are drivingly rotated about an axis perpendicular to the axis of the anvil 4. In this way, the power transmission is intermittently performed to intermittently rotate the end tool, so that the screw can be pulsatingly rotated and driven into a workpiece such as a wood.

With this structure, the switch body 20 is positioned in overlapping relation with the L-shaped battery pack 2 in the longitudinal direction of the impact driver 1. Therefore, the longitudinal length of the impact driver 1 can be reduced by an overlapping length of the switch body 20, to thus render the impact driver 1 compact. Further, the manipulation portion 21*a* of the pivot type trigger 21 is disposed at a center of gravity of the entire impact driver, and the pivot portion 22 is positioned between the manipulation portion 21*a* and the switch body 20. Therefore, a distance between the manipulation portion 21*a* and a hand gripped portion at the housing 5 can be shortened to thereby enhancing operability, since a user can easily access to the manipulation portion 21*a* by his finger of his hand while the user holds the hand gripped portion with the identical hand.

While the invention has been described in detail and with reference to the specific embodiments thereof, it would be apparent to those skilled in the art that various changes and modifications may be made therein without departing from the spirit and scope of the invention.

Industrial Applicability

The present invention is available for various types of portable power tool as long as the power tool includes a housing, a motor accommodated in the housing, a switch assembly having a switch body provided in the housing, and a battery pack assembled to one end of the housing.

The invention claimed is:

1. A portable electric power tool including:

a housing having a hand-gripped portion extending in a longitudinal direction, the hand-gripped portion having one end portion in which a battery is installable;

a motor accommodated in the housing; and a trigger provided at the hand-gripped portion and exposed to an atmosphere for access and operation, the trigger comprises a manipulation portion externally accessible and operable, a pivot portion supported to the hand gripped portion and pivotally movably supporting the manipulation portion, and a lever portion extending to the switch body from the manipulation portion via the pivot portion; and a switch body positioned in the housing and configured to perform switching of an electrical power supply to the motor, characterized in that the switch body is positioned to be overlapped with the battery in the longitudinal direction, and the trigger extends to the switch body.

2. The portable electric power tool as claimed in claim 1, characterized in that the hand-gripped portion has another end portion in which the motor is accommodated.

3. The portable electric power tool as claimed in claim 1, characterized in that the switch body comprises an ON/OFF switch, the ON/OFF switch and a part of the lever portion being positioned on an imaginary plane perpendicular to the longitudinal direction.

4. The portable electric power tool as claimed in claim 3, characterized in that the ON/OFF switch is rendered ON by the lever portion in response to the operation of the manipulation portion.

5. The portable electric power tool as claimed in claim 4, characterized in that the ON/OFF switch provides a ON direction perpendicular to a moving direction of the lever portion.

6. The portable electric power tool as claimed in claim 1, characterized in that the switch body comprises a speed change switch for changing a rotation speed of the motor, the speed change switch and a part of the lever portion being positioned on an imaginary plane perpendicular to the longitudinal direction.

7. The portable electric power tool as claimed in claim 6, characterized in that the speed change switch is operated by the lever portion in response to the operation of the manipulation portion.

8. The portable electric power tool as claimed in claim 6, wherein the speed change switch provides a speed changing direction parallel to a moving direction of the lever portion.

* * * * *